US006322706B1

(12) United States Patent
Ohkawa

(10) Patent No.: US 6,322,706 B1
(45) Date of Patent: Nov. 27, 2001

(54) RADIAL PLASMA MASS FILTER

(75) Inventor: Tihiro Ohkawa, La Jolla, CA (US)

(73) Assignee: Archimedes Technology Group, Inc., San Diego, CA (US)

( * ) Notice: Subject to any disclaimer, the term of this patent is extended or adjusted under 35 U.S.C. 154(b) by 0 days.

(21) Appl. No.: 09/353,689

(22) Filed: Jul. 14, 1999

(51) Int. Cl.[7] ..... B03C 1/00; B03D 21/20

(52) U.S. Cl. ..... 210/695; 210/748; 210/787; 210/222; 210/243; 210/512.1; 209/12.1; 209/227; 209/722; 96/2; 96/3; 95/28; 95/269; 55/447

(58) Field of Search ..... 210/695, 748, 210/787, 222, 223, 243, 512.1; 209/12.1, 227, 722; 96/1, 2, 3; 95/28; 55/447

(56) References Cited

U.S. PATENT DOCUMENTS

| | | | | |
|---|---|---|---|---|
| 3,722,677 | * | 3/1973 | Lehnert | 209/227 |
| 5,039,312 | | 8/1991 | Hollis, Jr. et al. . | |
| 5,350,454 | | 9/1994 | Ohkawa . | |
| 5,681,434 | | 10/1997 | Eastlund . | |
| 5,868,909 | | 2/1999 | Eastlund . | |

FOREIGN PATENT DOCUMENTS

WO 97/34685 9/1999 (WO) .

OTHER PUBLICATIONS

Anders, André, Interaction of Vacuum–Arc–Generated Macroparticles with a Liquid Surface; *Lawrence Berkeley National Laboratory*, University of California, Berkeley, California 94720, Feb., 1998.

Bittencourt, J.A. and Ludwig, G.O.; Steady State Behavior of Rotating Plasmas in a Vacuum–Arc Centrifuge; *Plasma Physics and Controlled Fusion*, vol. 29, No. 5; pp. 601–620; 1987 Great Britain.

Bonnevier, Björn; Experimental Evidence of Element and Isotope Separation in a Rotating Plasma; *Plasma Physics*, vol. 13, pp. 763–774; Northern Ireland, 1971.

Dallaqua, R.S., et al, *Experiments with Background Gas in a Vacuum Arc Centrifuge*, IEEE Transactions on Plasma Science, vol. 26, No. 3, Jun. 1998.

Dallaqua, R.S., et al, *Langmuir Probe Measurements in a Vacuum Arc Plasma Centrifuge*, IEEE Transactions on Plasma Science, vol. 26, No. 3, Jun. 1998.

Dallaqua, R.S., et al, *Radial Magnetic Field in Vacuum Arc Centrifuges*, J. Phys. D: Appl. Phys. 30 (1997), 2585–2590.

Evans, P.J.; Paoloni, F. J.; Noorman, J.T. and Whichello, J.V.; Measurements of Mass Separation in a Vacuum–Arc Centrifuge; *J. Appl. Phys.*, vol. 66, No. 1; pp. 115–118; Jul. 1, 1989.

Kim, C.; Jensen, R. V.; and Krishnan, M.; Equilibria of a Rigidly Rotating, Fully Ionized Plasma Column; *J. Appl. Phys.*; vol. 61, No. 9; pp. 4689–4690; May, 1987.

(List continued on next page.)

*Primary Examiner*—David A. Reifsnyder
(74) *Attorney, Agent, or Firm*—Nydegger & Associates

(57) ABSTRACT

A plasma filter for separating particles includes a hollow semi-cylindrical chamber that is enclosed by a wall. At least one plasma source is mounted in the chamber between the longitudinal axis of the chamber and the wall for generating a multi-species plasma containing light mass particles ($M_1$) and heavy mass particles ($M_2$). A magnetic coil is used to generate a magnetic field, $B_z$, in the chamber that is aligned parallel to the longitudinal axis, and electrodes at each end of the chamber generate an electric field, $E_r$, in the chamber that is oriented perpendicular to the longitudinal axis. These crossed electric and magnetic fields rotate the multi-species plasma on a curved path around the longitudinal axis, and in a plane substantially perpendicular to the longitudinal axis, to separate $M_1$ from $M_2$. Thus, the wall of the chamber acts as a circumferential collector for collecting the heavy mass particles ($M_2$), and a radial collector which is located at an azimuthal angle β from the plasma source, and which extends radially between the circumferential collector and the longitudinal axis, is used for collecting the light mass particles ($M_1$).

20 Claims, 4 Drawing Sheets

OTHER PUBLICATIONS

Krishnan, M.; Centrifugal Isotope Separation in Zirconium Plasmas; *Phys. Fluids* 26 (9); pp. 2676–2681; Sep., 1983.
Krishnan, Mahadevan and Prasad, Rahul R.; Parametric Analysis of Isotope Enrichment in a Vacuum–Arc Centrifuge; *J. Appl. Phys.* 57 (11); pp. 4973–4980; Jun. 1, 1985.
Geva, M.; Krishnan, M. and Hirshfield, J. L.; Element and Isotope Separation in a Vacuum–Arc Centrifuge; *J. Appl. Phys.* 56 (5); pp. 1398–1413; Sep. 1, 1984.
*Stable Isotope Production*, Nuclear Tech: Global Accomplishments and Opportunities, p. 531.
Ohkawa, T. et al., Plasma Confinement in a Toroidal Quadrupole, *Physics of Fluids*, 12, 1926 (1969).
Ohkawa, T. et al., Plasma Confinement in D.C. Octopole, *Phys Rev. Letters* 24,95 (1970).
Prasad, Rahul R.; Krishnan, Mahadevan; Theoretical and Experimental Study of Rotation in a Vacuum–Arc Centrifuge; *J. Appl. Phys.*, vol. 61, No. 1; pp. 113–119; Jan. 1, 1987.
Prasad, Rahul R., and Krishnan, Mahadevan; Article from *J. Appl. Phys.* 61 (9); pp. 4464–4470; American Institute of Physics; May 1, 1987.
Simpson, S.W.; Dallaqua, R. S.; and Del Bosco, E; Acceleration Mechanism in Vacuum Arc Centrifuges; *J. Phys.D.: Appl. Phys.* 29; pp. 1040–1046; UK 1996.

* cited by examiner

RADIAL PLASMA MASS FILTER

FIELD OF THE INVENTION

The present invention pertains generally to particle filters. More particularly, the present invention pertains to plasma filters which are effective for processing a multi-species plasma to separate light mass particles in the plasma from heavy mass particles in the plasma. The present invention is particularly, but not exclusively, useful for the remediation of nuclear waste.

BACKGROUND OF THE INVENTION

The general principles of operation for a plasma centrifuge are well known and well understood. In short, a plasma centrifuge generates forces on charged particles which will cause the particles to separate from each other according to their mass. More specifically, a plasma centrifuge relies on the effect crossed electric and magnetic fields have on charged particles. As is known, crossed electric and magnetic fields will cause charged particles in a plasma to move through the centrifuge on respective helical paths around a centrally oriented longitudinal axis. As the charged particles transit the centrifuge under the influence of these crossed electric and magnetic fields they are, of course, subject to various forces. Specifically, in the radial direction, i.e. a direction perpendicular to the axis of particle rotation in the centrifuge, these forces are: 1) a centrifugal force, $F_c$, which is caused by the motion of the particle; 2) an electric force, $F_E$, which is exerted on the particle by the electric field, $E_r$; and 3) a magnetic force, $F_B$, which is exerted on the particle by the magnetic field, $B_z$. Mathematically, each of these forces are respectively expressed as:

$$F_c=Mr\omega^2;$$

$$F_E=eE_r; \text{ and}$$

$$F_B=er\omega B_z.$$

Where:

M is the mass of the particle;

r is the distance of the particle from its axis of rotation;

ω is the angular frequency of the particle;

e is the electric charge of the particle;

E is the electric field strength; and $B_z$ is the magnetic flux density of the field.

In a plasma centrifuge, it is general practice that the electric field will be directed radially inward. Stated differently, there is an increase in positive voltage with increased distance from the axis of rotation in the centrifuge. Under these conditions, the electric force $F_E$ will oppose the centrifugal force $F_C$ acting on the particle, and depending on the direction of rotation, the magnetic force either opposes or aids the outward centrifugal force. Accordingly, an equilibrium condition in a radial direction of the centrifuge can be expressed as:

$$\Sigma F_r=0 \text{ (positive direction radially outward) } F_c-F_E-F_B=0Mr\omega^2-eE_r-er\omega B_z=0 \quad \text{(Eq. 1)}$$

It is noted that Eq. 1 has two real solutions, one positive and one negative, namely:

$$\omega=\Omega/2\left(1\pm\sqrt{1+4E_r/(rB_z\Omega)}\right)$$

where $\Omega=eB_z/M$.

For a plasma centrifuge, the intent is to seek an equilibrium to create conditions in the centrifuge which allow the centrifugal forces, $F_c$, to separate the particles from each other according to their mass. This happens because the centrifugal forces differ from particle to particle, according to the mass (M) of the particular particle. Thus, particles of heavier mass experience greater $F_c$ and move more toward the outside edge of the centrifuge than do the lighter mass particles which experience smaller centrifugal forces. The result is a distribution of lighter to heavier particles in a direction outward from the mutual axis of rotation. As is well known, however, a plasma centrifuge will not completely separate all of the particles in the aforementioned manner.

As an alternative to the plasma centrifuge, an apparatus which is structurally similar but which is operationally and functionally very dissimilar has been more recently developed. This alternative apparatus is referred to herein as a plasma mass filter and is fully disclosed in co-pending U.S. application Ser. No. 09/192,945 now U.S. Pat. No. 6,096,220 for an invention of Ohkawa entitled "Plasma Mass Filter" which is assigned to the same assignee as the present invention. The fundamental difference between a plasma centrifuge and a plasma mass filter is that, unlike a plasma centrifuge which relies on collisions between the various ions as they are rotated in the plasma chamber, a plasma mass filter relies on the ability of the ions to orbit inside the plasma chamber. Thus, the basic principles of the separation are quite different.

As indicated above in connection with Eq. 1, a force balance can be achieved for all conditions when the electric field E is chosen to confine ions, and ions exhibit confined orbits. In a plasma filter, however, unlike a centrifuge, the electric field is chosen with the opposite sign to extract ions. The result is that ions of mass greater than a cut-off value, $M_c$, are on unconfined orbits. The cut-off mass, $M_c$, can be selected by adjusting the strength of the electric and magnetic fields. The basic features of the plasma filter can be described using the Hamiltonian formalism.

The total energy (potential plus kinetic) is a constant of the motion and is expressed by the Hamiltonian operator:

$$H=e\Phi+(P_R^2+P_z^2)/(2M)+(P_\theta-e\Psi)^2/(2Mr^2)$$

where $P_R=MV_R$, $P_\theta=MrV_\theta+e\Psi$, and $P_z=MV_z$ are the respective components of the momentum and $e\Phi$ is the potential energy. $\Psi=r^2B_z/2$ is related to the magnetic flux function and $\Phi=\alpha\Psi+V_{ctr}$ is the electric potential. $E=-\nabla\Phi$ is the electric field which is chosen to be greater than zero for the filter case of interest. We can rewrite the Hamiltonian:

$$H=e\alpha r^2B_z/2+eV_{ctr}+(P_R^2+P_z^2)/(2M)+(P_\theta-er^2B_z/2)^2/(2Mr^2)$$

We assume that the parameters are not changing along the z axis, so both $P_z$ and $P_\theta$ are constants of the motion. Expanding and regrouping to put all of the constant terms on the left hand side gives:

$$H-eV_{ctr}-P_z^2/(2M)+P_\theta\Omega/2=P_R^2/(2M)+(P_\theta^2/(2Mr^2)+(M\Omega r^2/2)(\Omega/4+\alpha)$$

where $\Omega = eB/M$.

The last term is proportional to $r^2$, so if $\Omega/4+\alpha<0$ then, since the second term decreases as $1/r^2$, $P_R^2$ must increase to keep the left-hand side constant as the particle moves out in radius. This leads to unconfined orbits for masses greater than the cut-off mass given by:

$$Mc=e(B_z a)^2/(8V_{ctr}) \text{ where we used:}$$

$$\alpha=(\Phi-V_{ctr})/\Psi=-2V_{ctr}(a^2B_z) \quad \text{(Eq. 2)}$$

and where a is the radius of the chamber.

So, for example, normalizing to the proton mass, $M_p$, we can rewrite Eq. 2 to give the voltage required to put higher masses on loss orbits:

$$V_{ctr}>1.2\times10^{-1}(a(m)B(gauss))^2/(M_C/M_P)$$

Hence, a device radius of 1 m, a cutoff mass ratio of 100, and a magnetic field of 200 gauss require a voltage of 48 volts.

The same result for the cut-off mass can be obtained by looking at the simple force balance equation given by:

$$\Sigma F_r=0 \text{ (positive direction radially outward) } F_c+F_E+F_B=0Mr\omega^2+eEr-er\omega B_z=0 \quad \text{(Eq. 3)}$$

which differs from Eq. 1 only by the sign of the electric field and has the solutions:

$$\omega = \Omega/2\left(1 \pm \sqrt{1-4E/(rB_z\Omega)}\right)$$

so if $4E/r\Omega B_z>1$ then $\omega$ has imaginary roots and the force balance cannot be achieved. For a filter device with a cylinder radius "a", a central voltage, $V_{ctr}$, and zero voltage on the wall, the same expression for the cut-off mass is found to be:

$$M_C=ea^2B_z^2/8V_{ctr} \quad \text{(Eq. 4)}$$

When the mass M of a charged particle is greater than the threshold value ($M>M_c$), the particle will continue to move radially outwardly until it strikes the wall, whereas the lighter mass particles will be contained. The higher mass particles can also be recovered from the walls using various approaches.

It is important to note that for a given device the value for $M_c$ in equation 3 is determined by the magnitude of the magnetic field, $B_z$, and the voltage at the center of the chamber (i.e. along the longitudinal axis), $V_{ctr}$. These two variables are design considerations and can be controlled. It is also important that the filtering conditions (Eqs. 2 and 3) are not dependent on boundary conditions. Specifically, the velocity and location where each particle of a multi-species plasma enters the chamber does not affect the ability of the crossed electric and magnetic fields to eject high-mass particles ($M>M_c$) while confining low-mass particles ($M<M_c$) to orbits which remain within the distance "a" from the axis of rotation.

It happens that in a plasma mass filter, wherein ions are subjected to the conditions disclosed above, those ions which have a mass greater than the cut-off value, $M_c$, will follow unconfined orbits that cause them to be rapidly ejected from the space where ions having a mass less than the cut-off value are confined. Actually, this separation typically occurs in less than one-half of a rotation of a multi-species plasma about its axis of rotation. Due to this quite rapid separation of heavy mass particles from light mass particles, the present invention recognizes that it is not necessary for the multi-species plasma to be moved in translation through the plasma chamber. Instead, the particles can be separated in the plasma according to their mass while being constrained to move in rotation.

In light of the above, it is an object of the present invention to provide a radial plasma mass filter having a substantially semi-cylindrical plasma chamber wherein the source of a multi-species plasma is azimuthally distanced from the collector that is to be used for collecting the light mass ions from the plasma, while the heavy mass ions are ejected into the chamber wall. It is another object of the present invention to provide a radial plasma mass filter wherein the electrodes for generating the electric field in the plasma chamber are removed from the path of the multi-species plasma as the plasma rotates about an axis of rotation in the plasma chamber. Yet another object of the present invention is to provide a radial plasma mass filter wherein the crossed electric and magnetic fields in the plasma chamber act to draw the multi-species plasma from its source into the chamber. Still another object of the present invention is to provide a radial plasma mass filter wherein antennae can be located sufficiently near the source of the multi-species plasma to heat electrons at the source. Another object of the present invention is to provide a radial plasma mass filter in which the magnetic field is oriented in the plasma chamber so that electrical disturbances at the ion collector are impeded from propagating back upstream to the source in a direction that would be perpendicular to the magnetic field. Another object of the present invention is to provide a radial plasma mass filter which is relatively easy to manufacture, functionally simple to operate, and comparatively cost effective.

SUMMARY OF THE PREFERRED EMBODIMENTS

In accordance with the present invention, a radial plasma filter for separating particles in a multi-species plasma from each other includes a hollow, enclosed semi-cylindrical chamber that defines a longitudinal axis. The chamber is surrounded by a wall which is located at a radial distance "a" from the longitudinal axis, and it has closed ends. A plurality of plasma sources for generating the multi-species plasma are mounted inside the chamber. Specifically, the plurality of plasma sources are aligned longitudinally in the chamber, and they are positioned between the longitudinal axis of the chamber and the wall. As intended for the present invention, the plurality of plasma sources generate a multi-species plasma which contains both light mass particles ($M_1$) and heavy mass particles ($M_2$).

A plurality of magnetic coils surround the chamber and are centered on the longitudinal axis. Further, these magnetic coils are oriented in respective planes that are substantially perpendicular to the longitudinal axis. As so oriented the magnetic coils generate a magnetic field, $B_z$, inside the chamber, that is aligned substantially parallel to the longitudinal axis. Additionally, there is an electrode at each end of the chamber. For the present invention, the two electrodes act together to generate an electric field, $E_r$, inside the chamber, that is oriented substantially perpendicular to the longitudinal axis. Importantly, this electric field ($E_r$) has a positive potential along the longitudinal axis of the chamber, $V_{ctr}$, and it has a substantially zero potential at the wall of the chamber. The crossed electric field ($E_r$) and magnetic field ($B_z$) thereby act in concert to rotate the multi-species plasma on a curved path inside the chamber around the longitudinal axis. Due to the configuration of the present invention, this respective curved path for particles in the multi-species plasma will lie in a plane that is substantially perpendicular to the longitudinal axis.

Separation of the light mass particles ($M_1$) from the heavy mass particles ($M_2$) in the multi-species plasma is determined by the selection of operational parameters for the plasma filter. Specifically, values for the magnitude of the magnetic field $B_z$, the magnitude of $V_{ctr}$ for the electric field, $E_r$, and the radial distance "a"between the longitudinal axis and the wall of the chamber are selected to satisfy the expression $M_C=ea^2\ B_z^2/8V_{ctr}$. In this expression, e is the electric charge of a particle and $M_c$ is a cut-off mass. More specifically, $M_c$ is selected to be greater than $M_1$ and less than $M_2$ ($M_1<M_c<M_2$). The consequence here is that as the multi-species plasma is rotated along its curved path, the particles of heavy mass $M_2$ are ejected into said wall of said chamber. On the other hand, the particles of light mass $M_1$ are directed into a radial collector which is mounted in the chamber between the longitudinal axis and the wall, and is located at an azimuthal angle, β, from the plasma source. A convenient choice for β is approximately equal to one hundred eighty degrees (β=180°).

In addition to the above described structure for the present invention, the plasma filter can include a pair of gaseous plasma generators that will each be mounted at one end of the chamber. Specifically, each gaseous plasma generator will be positioned adjacent a respective electrode, and located axially between the electrode and the nearest plasma source. As so positioned, the gaseous plasma generators can generate a gaseous plasma at each end of the chamber which will shield the electrodes from the multi-species plasma that is generated by the plasma sources inside the chamber. Preferably, the gaseous plasma that is generated comes from a light gas such as helium gas (He). Further, the plasma filter of the present invention includes antennae mounted in the chamber adjacent to or surrounding each of the plasma sources for heating electrons in the multi-species plasma at the source.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF THE PREFERRED EMBODIMENT

Figure 1:
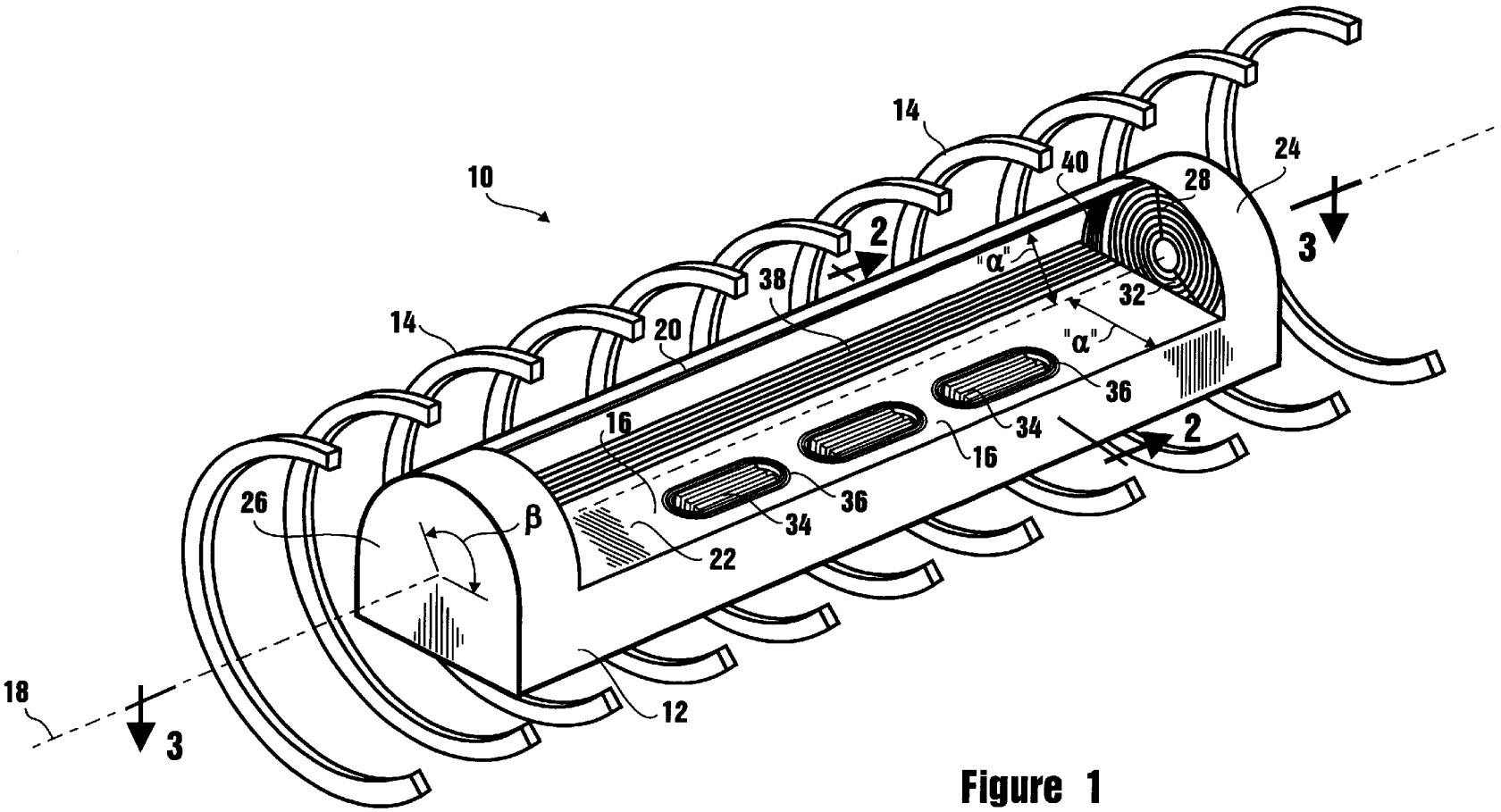
FIG. 1 is a perspective view of the radial plasma mass filter of the present invention which selected portions broken away for clarity.

Referring initially to FIG. 1 a radial plasma filter in accordance with the present invention is shown and is generally designated 10. More specifically, as shown, the radial plasma filter 10 of the present invention includes a housing 12 which is surrounded by a plurality of magnetic coils 14. Additionally, the radial plasma filter 10 includes a semi-cylindrical chamber 16 which defines a longitudinal axis 18 that extends along the length of the chamber 16 and housing 12. Further, the chamber 16 is generally defined by the space that is bounded by a semicircular curved wall 20 which covers the top of the chamber 16, a platform 22 which is opposite the wall 20 and which establishes the bottom of the chamber 16, and the end panels 24 and 26. For the configuration of chamber 16 as shown in FIG. 1, the longitudinal axis 18 will be aligned on the platform 22. As intended for the present invention, the magnetic coils 14 can be of any type well known in the pertinent art which are capable of generating a magnetic field, $B_z$, in the chamber 16 that is aligned substantially parallel to the longitudinal axis 18.

Figure 2:
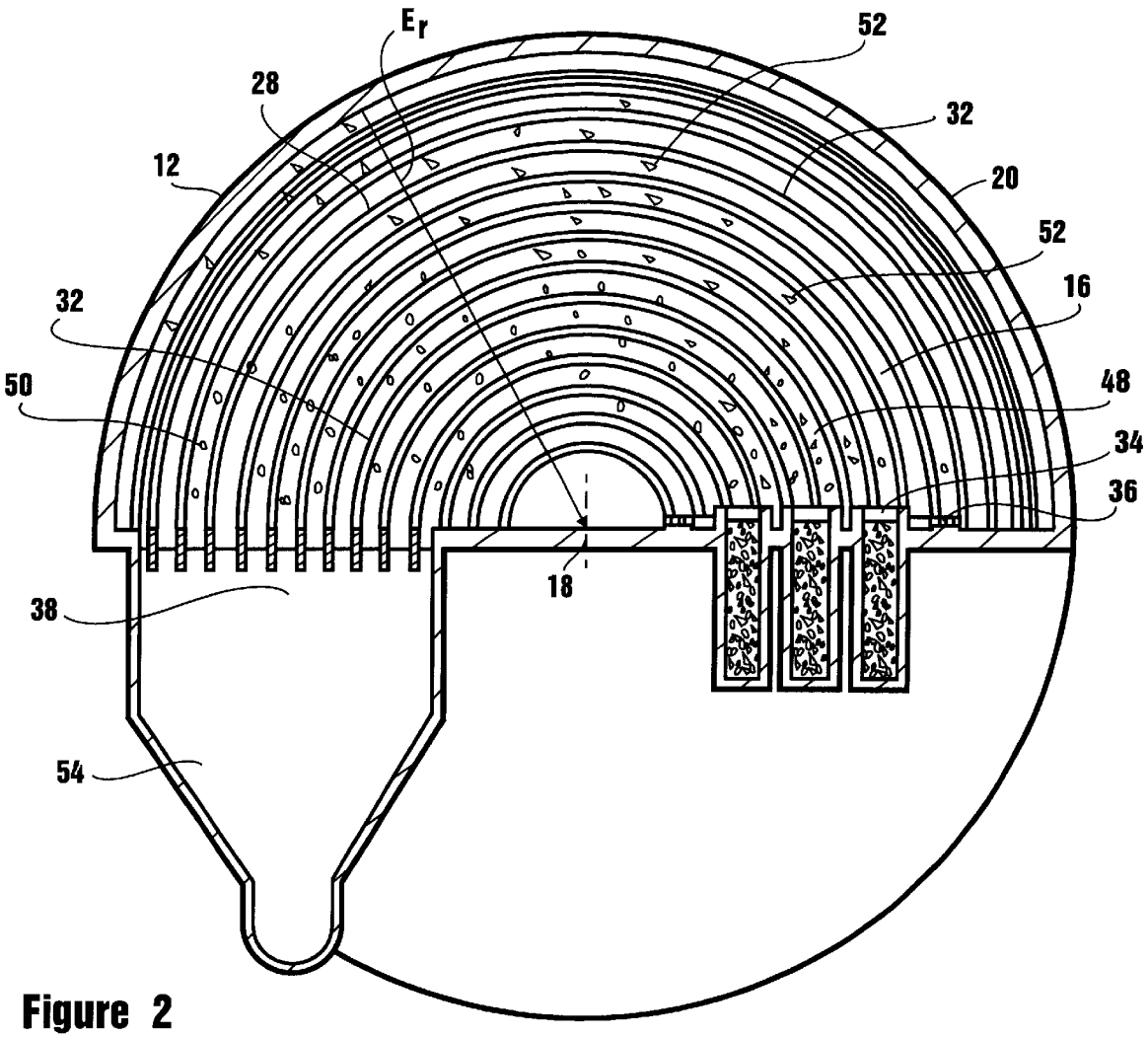
FIG. 2 is a cross sectional view of the plasma mass filter as seen in elevation along the line 2—2 in FIG. 1.

FIG. 1 also shows that an electrode 28 is mounted inside the chamber 16 at the end panel 24. At the opposite end of the chamber 16, another electrode 30 (not shown in FIG. 1) is mounted inside the chamber 16 at the end panel 26. Both electrode 28 and electrode 30 are essentially similar to each other and their respective configurations can perhaps be best appreciated by reference to FIG. 2 wherein the electrode 28 is shown in detail. More specifically, in FIG. 2 the electrode 28 is seen to comprise a plurality of concentric voltage control rings 32 which are centered on the longitudinal axis 18 of the semi-cylindrical chamber 16. Importantly, the electrodes 28 and 30 act together to generate an electric field, $E_r$, in the chamber 16, which is oriented substantially perpendicular to the longitudinal axis 18 of the chamber 16. It is also important that this electric field, $E_r$, have a positive potential, $V_{ctr}$, along the longitudinal axis 18 and a substantially zero potential at the wall 20 of the chamber 16. With this orientation, the electric field ($E_r$) is effectively crossed with the magnetic field ($B_z$) inside the chamber 16.

Returning to FIG. 1 it will be seen that the radial plasma filter 10 of the present invention includes a plurality of plasma sources 34 which are arranged and aligned longitudinally on the platform 22. Surrounding each of the plasma sources 34 is a respective antenna 36. Also, diametrically opposite the longitudinal axis 18 from the plurality of plasma sources 34 is a collector 38. As shown, like the plurality of plasma sources 34, the collector 38 is also aligned longitudinally on the platform 22. In the particular configuration for the radial plasma filter 10 in FIG. 1, the platform 22 is flat and the azimuthal angle, β (which is an angle measured around the longitudinal axis 18 as shown on the end panel 26 in FIG. 1) is equal to one hundred eighty degrees (β=180°). It is to be appreciated, however, that other configurations for the panel 22 can be used wherein the azimuthal angle β will have values which may be more or less than one hundred eighty degrees.

Figure 3:
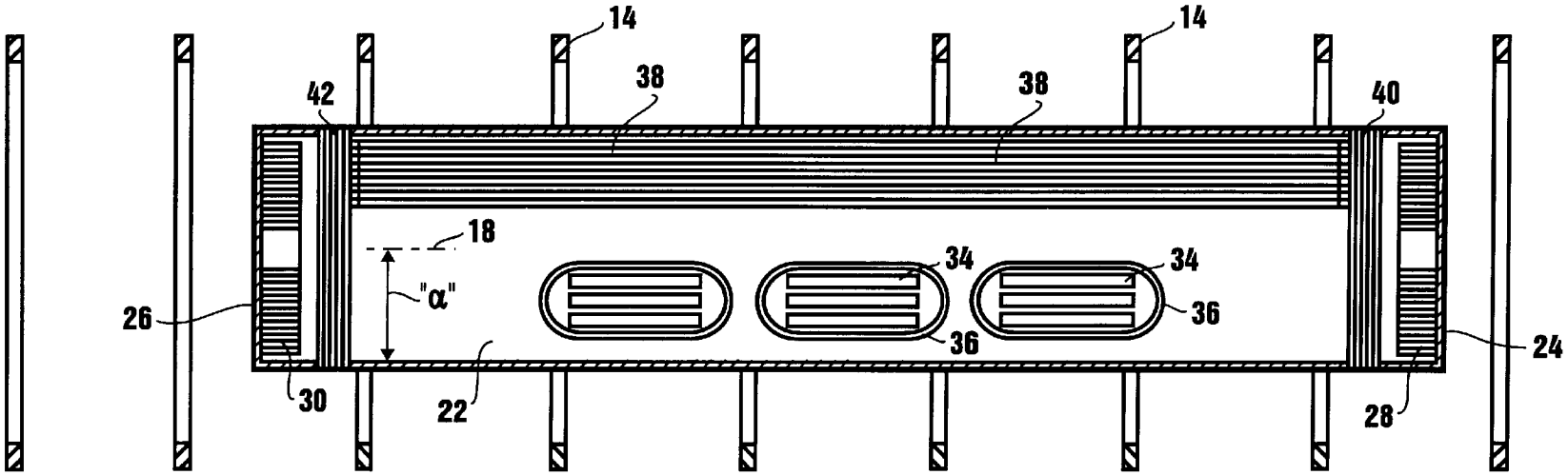
FIG. 3 is a cross sectional top plan view of the plasma mass filter as seen along the line 3—3 in FIG. 1.

By cross-referencing FIG. 1 with FIG. 3, it will be seen that the radial plasma filter 10 of the present invention includes a plasma generator 40 and a plasma generator 42 which are located at opposite ends of the chamber 16. The plasma generators 40 and 42 are structurally, and functionally, essentially the same. Specifically, both plasma generators 40 and 42 are located longitudinally between a respective electrode 28 and 30 and the platform 22. Stated differently, each of the electrodes 28 and 30 are separated from the plasma sources 34 and the collector 38 by a respective plasma generator 40 and 42.

OPERATION

In the operation of the radial plasma filter 10 of the present invention, the magnetic coils 14 and the electrodes 28 and 30 are activated to generate crossed magnetic and electric fields ($E_r \times B_z$) in the chamber 16. Specifically, a value for $V_{ctr}$, the positive potential of the electric field $E_r$ along the longitudinal axis 18, and the magnitude of the magnetic field, $B_z$, are selected with the values for radius "a" of the chamber 16 and the electric charge of a particle, e, to satisfy the expression derived above for the cut-off mass: $M_c = ea^2B_z^2/8V_{ctr}$. Additionally, the plasma generators 40 and 42 are activated to create respective gaseous plasmas 44 and 46 (see FIG. 4). Specifically, the gaseous plasmas 44 and 46 are preferably generated using a light gas, such as helium (He), and they are maintained in the chamber 16 to cover the respective electrodes 28 and 30. Thus, the gaseous plasmas 44 and 46 shield and separate the electrodes 28 and 30 from the interior of the chamber 16 where the plasma sources 34 and the collector 38 are located.

Figure 4:
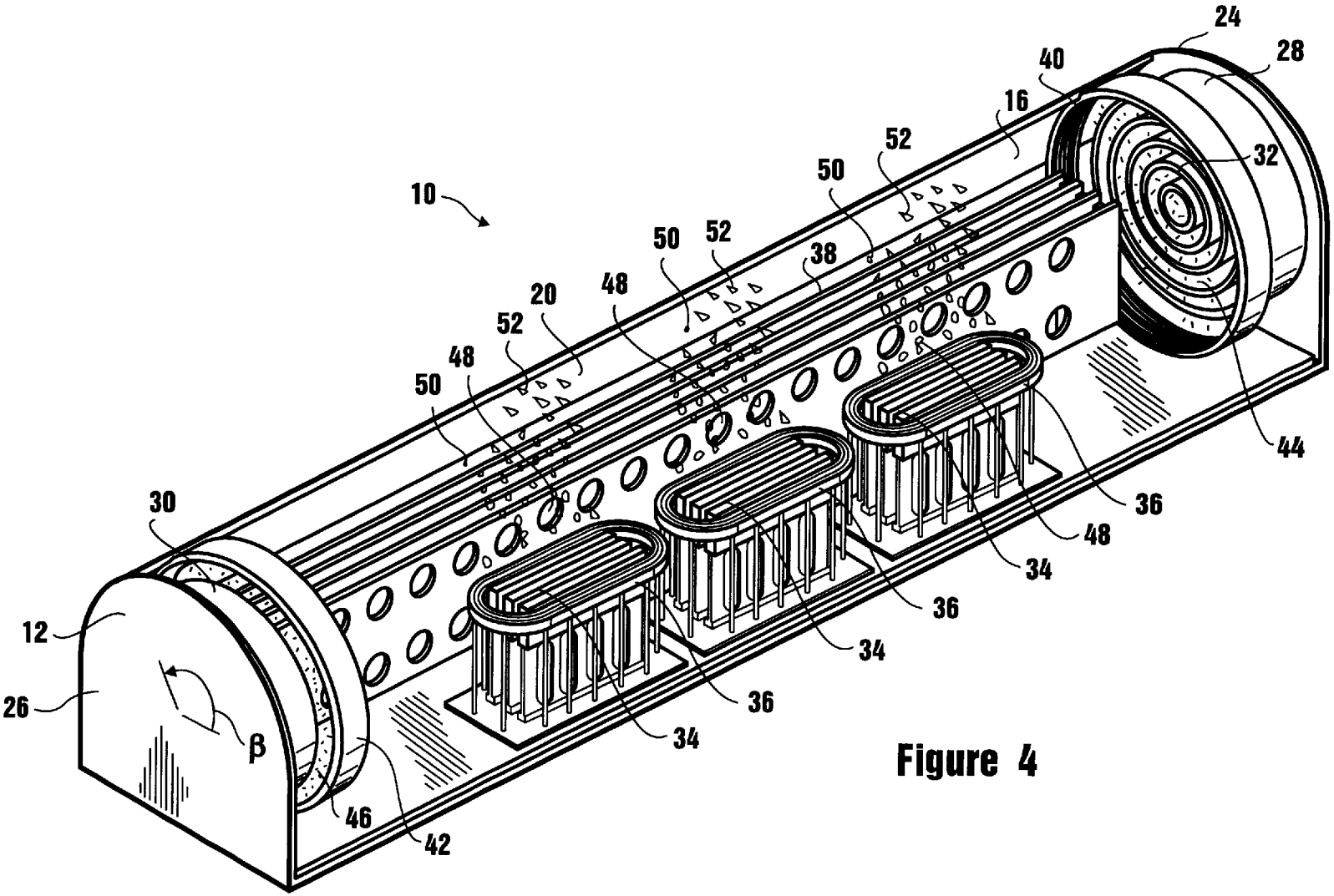
FIG. 4 is another perspective view of the radial plasma mass filter of the present invention, as also generally seen in FIG. 1, with selected portions broken away and additional portions removed for clarity.

As best appreciated with reference to FIG. 4, activation of the antennae 36 will cause the plasma sources 34 to generate a multi-species plasma 48. For the present invention, it is envisioned that the multi-species plasma 48 will contain both light mass particles 50 having a mass $M_1$, and heavy mass particles 52 which have a mass $M_2$. Thus, as the multi-species plasma 48 is generated, and the particles 50 and 52 of the multi-species plasma 48 are ejected from the plasma sources 34 into the chamber 16, both the particles 50 and the particles 52 are influenced by the crossed electric and magnetic fields ($E_r \times B_z$). In accordance with the physics discussed above, when the cut-off mass, $M_c$, is selected such that $M_1 < M_c < M_2$, the light mass particles 50 ($M_1$) will remain in confined orbits as they rotate about the longitudinal axis 18. More specifically, as the light mass particles 50 rotate through the azimuthal angle β from the plasma sources 34 toward the collector 38 the light mass particles 50 will remain within the distance "a" from the longitudinal axis 18. Consequently, the light mass particles 50 ($M_1$) will be collected in the bin 54 of collector 38. On the other hand, the heavy mass particles 52 ($M_2$) will not follow such confined orbits, and their trajectories as they rotate about the axis 18 will cause them to collide with the wall 20 of chamber 16 before they reach the collector 38. In this manner, the light mass particles 50 are separated from the heavy mass particles 52 in the radial plasma filter 10 of the present invention.

Several benefits are realized from the configuration of the radial plasma filter 10 disclosed above. One such benefit is that the electrodes 28 and 30 act in the radial plasma filter 10 only as electrodes. The electrodes 28 and 30 do not function as collectors. This cooperation of structure is further ensured by the gaseous plasmas 44 and 46 which, when generated, will serve to protect and shield the respective electrodes 28 and 30 from the multi-species plasma 48. Another such benefit derives from the location and orientation of the plasma sources 34 relative to the crossed electric and magnetic fields ($E_r \times B_z$) in the chamber 16. Specifically, for the configuration of the radial filter plasma 10 of the present invention, the crossed electric and magnetic fields ($E_r \times B_z$) will act to draw the multi-species plasma 48 away from the plasma sources 34. As will be appreciated by the skilled artisan this action actually facilitates the initial rotation of particles 50 and 52 in the direction of the azimuthal angle β through the chamber 16. An additional benefit is that the antennae 36 are located around the plasma sources 34 in a way which allows the antennae 36 to heat electrons in the multi-species plasma 48 at the source 34. Finally, because the magnetic field $B_z$ is oriented parallel to the axis of rotation 18, any electrical disturbances which might occur at the collector 38 will be impeded by the magnetic field from propagating back to the plasma sources 34. Such a propagation of an electrical disturbance will, of course, also be impeded by the fact that the disturbance must move upstream, against the rotational movement of the multi-species plasma 48.

While the particular Radial Plasma Mass Filter as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A plasma filter for separating light mass particles, $M_1$, from heavy mass particles, $M_2$, which comprises:

a hollow semi-cylindrical chamber defining a longitudinal axis, said chamber being enclosed by a wall located at a radial distance "a" from said axis, said chamber having a first end and a second end;

at least one plasma source mounted in said chamber between the longitudinal axis and said wall, and between said first end and said second end, for generating a multi-species plasma with the multi-species plasma containing light mass particles ($M_1$) and heavy mass particles ($M_2$);

a means for generating a magnetic field, $B_z$, in said chamber, said magnetic field being aligned substantially parallel to the longitudinal axis;

a means for generating an electric field, $E_r$, in said chamber, said electric field having a positive potential on the longitudinal axis, $V_{ctr}$, and a substantially zero potential at said wall of said chamber, said electric field being oriented substantially perpendicular to the longitudinal axis and crossed with said magnetic field to rotate said multi-species plasma around the longitudinal axis to separate the light mass particles ($M_1$) from the heavy mass particles ($M_2$).

2. A plasma filter as recited in claim 1 further comprising a collector mounted in said chamber between the longitudinal axis and said wall, and between said first end and said second end, and located at an azimuthal angle, β, from said plasma source.

3. A plasma filter as recited in claim 2 wherein said azimuthal angle is substantially equal to one hundred eighty degrees (β=180°).

4. A plasma filter as recited in claim 2 wherein said magnetic field, $B_z$, is generated by a plurality of magnetic coils, with each said magnetic coil centered on the longitudinal axis and oriented in a plane substantially perpendicular to the longitudinal axis, and with each said magnetic coil being axially distanced along the longitudinal axis from an adjacent said magnetic coil.

5. A plasma filter as recited in claim 4 wherein said electric field, $E_r$, is generated by a first electrode located at said first end of said chamber, and a second electrode located at said second end of said chamber.

6. A plasma filter as recited in claim 5 wherein said first electrode and said second electrode comprise a plurality of voltage control rings centered on the longitudinal axis.

7. A plasma filter as recited in claim 5 wherein $B_z$, $E_r$, and the radial distance "a" satisfy the expression $M_c = ea^2B_z^2/8V_{ctr}$, where e is the electric charge of a particle and $M_c$ is selected as a cut-off mass greater than $M_1$ and less than $M_2$ ($M_1 < M_c < M_2$) to thereby eject particles of mass $M_2$ into said wall of said chamber and direct particles of mass $M_1$ into said collector.

8. A plasma filter as recited in claim 5 further comprising:

a first gaseous plasma generator mounted in said chamber adjacent said first electrode and axially positioned between said first electrode and said plasma source for generating a gaseous plasma near said first end of said chamber to shield said first electrode from the multi-species plasma generated by said plasma source; and a second gaseous plasma generator mounted in said chamber adjacent said second electrode and axially positioned between said second electrode and said plasma source for generating a gaseous plasma near said second end of said chamber to shield said second electrode from the multi-species plasma generated by said plasma source.

9. A plasma filter as recited in claim 8 wherein the gaseous plasma is generated from a helium gas (He).

10. A plasma filter as recited in claim 1 further comprising an antenna mounted in said chamber and surrounding said plasma source for heating electrons in the multi-species plasma.

11. A plasma filter which comprises:

a means for generating a multi-species plasma having light mass particles ($M_1$) and heavy mass particles ($M_2$), wherein said multi-species plasma is moved along a curved path in rotation about an axis, the curved path being substantially in a plane perpendicular to the axis of rotation;

a means for generating a magnetic field, $B_z$, said magnetic field being aligned substantially parallel to the axis of rotation;

a means for generating an electric field, $E_r$, said electric field having a positive potential on the axis of rotation and a substantially zero potential away from the axis of rotation, said electric field being oriented substantially perpendicular to the axis of rotation and crossed with said magnetic field to rotate said multi-species plasma on the curved path around the axis of rotation to separate the light mass particles ($M_1$) from the heavy mass particles ($M_2$);

a circumferential collector substantially located in the plane at a radial distance "a" from the axis of rotation for collecting the heavy mass particles ($M_2$); and a radial collector substantially located in the plane and oriented substantially perpendicular to said circumferential collector, said radial collector extending radially in the plane between said circumferential collector and the axis of rotation for collecting the light mass particles ($M_1$), said radial collector being at an azimuthal angle $\beta$ in the plane from said means for generating a multi-species plasma.

12. A plasma filter as recited in claim 11 wherein said means for generating a multi-species plasma is mounted in a hollow semi-cylindrical chamber defining a longitudinal axis coincident with the axis of rotation, wherein said chamber is enclosed by a wall located at the radial distance "a" from the axis of rotation, wherein said chamber has a first end and a second end.

13. A plasma filter as recited in claim 12 wherein said circumferential collector is said wall of said chamber.

14. A plasma filter as recited in claim 12 wherein said magnetic field, $B_z$, is generated by a plurality of magnetic coils, with each said magnetic coil centered on the longitudinal axis and oriented in a plane substantially perpendicular to the longitudinal axis, and with each said magnetic coil being axially distanced along the longitudinal axis from an adjacent said magnetic coil, and wherein said electric field, $E_r$, is generated by a first electrode located at said first end of said chamber, and a second electrode located at said second end of said chamber.

15. A plasma filter as recited in claim 14 wherein $B_z$, $E_r$, and the radial distance "a" satisfy the expression $M_c=ea^2B_z^2/8V_{ctr}$, where e is the electric charge of a particle and $M_c$ is selected as a cut-off mass greater than $M_1$ and less than $M_2$ ($M_1<M_c<M_2$) to thereby eject particles of mass $M_2$ into said wall of said chamber and direct particles of mass $M_1$ into said collector.

16. A plasma filter as recited in claim 15 further comprising:

a first gaseous plasma generator mounted in said chamber adjacent said first electrode and axially positioned between said first electrode and said plasma source for generating a gaseous plasma near said first end of said chamber to shield said first electrode from the multi-species plasma; and a second gaseous plasma generator mounted in said chamber adjacent said second electrode and axially positioned between said second electrode and said plasma source for generating a gaseous plasma near said second end of said chamber to shield said second electrode from the multi-species plasma.

17. A method separating light mass particles, $M_1$, from heavy mass particles, $M_2$, which comprises the steps of:

providing a hollow semi-cylindrical chamber defining a longitudinal axis, said chamber being enclosed by a wall located at a radial distance "a" from said axis, said chamber having a first end and a second end with at least one plasma source mounted in said chamber between the longitudinal axis and said wall, and between said first end and said second end;

activating said plasma source to generate a multi-species plasma with the multi-species plasma containing light mass particles ($M_1$) and heavy mass particles ($M_2$);

generating a magnetic field, $B_z$, in said chamber, said magnetic field being aligned substantially parallel to the longitudinal axis; and generating an electric field, $E_r$, in said chamber, said electric field having a positive potential on the longitudinal axis, $V_{ctr}$, and a substantially zero potential at said wall of said chamber, said electric field being oriented substantially perpendicular to the longitudinal axis and crossed with said magnetic field to rotate said multi-species plasma around the longitudinal axis to separate the light mass particles ($M_1$) from the heavy mass particles ($M_2$).

18. A method as recited in claim 17 wherein said magnetic field, $B_z$, is generated by a plurality of magnetic coils, with each said magnetic coil centered on the longitudinal axis and oriented in a plane substantially perpendicular to the longitudinal axis, and with each said magnetic coil being axially distanced along the longitudinal axis from an adjacent said magnetic coil, and wherein said electric field, $E_r$, is generated by a first electrode located at said first end of said chamber, and a second electrode located at said second end of said chamber.

19. A method as recited in claim 18 wherein $B_z$, $E_r$, and the radial distance "a" satisfy the expression $M_c=ea^2B_z^2/$ $8V_{ctr}$, where e is the electric charge of a particle and Mc is selected as a cut-off mass greater than $M_1$ and less than $M_2$ ($M_1<M_c<M_2$) to thereby eject particles of mass $M_2$ into said wall of said chamber and direct particles of mass $M_1$ into said collector.

20. A method as recited in claim 19 further comprising the steps of:

mounting a first gaseous plasma generator in said chamber adjacent said first electrode and axially positioned between said first electrode and said plasma source for generating a gaseous plasma near said first end of said chamber to shield said first electrode from the multi-species plasma generated by said plasma source; and mounting a second gaseous plasma generator in said chamber adjacent said second electrode and axially positioned between said second electrode and said plasma source for generating a gaseous plasma near said second end of said chamber to shield said second electrode from the multi-species plasma generated by said plasma source.

* * * * *

UNITED STATES PATENT AND TRADEMARK OFFICE

CERTIFICATE OF CORRECTION

PATENT NO. : 6,322,706 B1
DATED : November 27, 2001
INVENTOR(S) : Tihiro Ohkawa

It is certified that error appears in the above-identified patent and that said Letters Patent is hereby corrected as shown below:

Column 1,
Line 63, delete "$\Sigma F_r = 0$ (positive direction radially outward) $F_c - F_E - F_B = 0$ $Mr\omega^2 - eE_r - er\omega B_z = 0$" insert
-- $\Sigma F_r = 0$ (positive direction radially outward)

$F_c - F_E - F_B = 0$ $Mr\omega^2 - eE_r - er\omega B_z = 0$ --

Column 2,
Line 1, delete "$\omega = \Omega / 2 (1 \pm \sqrt{1 + 4E_r / (rB_z\Omega)})$" insert -- $\omega = \Omega / 2 (1 \pm \sqrt{1 + 4E_r / (rB_z\Omega)})$ --

Column 3,
Line 9, delete "$Mc = e(B_2a)^2/(8V_{ctr})$ where we used" insert -- $M_c = e(B_2a)^2/(8V_{ctr})$ where we used --

Signed and Sealed this

Sixth Day of August, 2002

*Attest:*

*Attesting Officer*

JAMES E. ROGAN
*Director of the United States Patent and Trademark Office*